United States Patent [19]

Edwards

[11] Patent Number: 4,479,344

[45] Date of Patent: Oct. 30, 1984

[54] EXPANDERS FOR THE FILLING OF SACKS AND BAGS

[75] Inventor: Desmond F. Edwards, Nassau, The Bahamas

[73] Assignee: Codel International Ltd., Nassau, The Bahamas

[21] Appl. No.: 363,813

[22] Filed: Mar. 31, 1982

[30] Foreign Application Priority Data

Apr. 28, 1981 [GB] United Kingdom ..... 8113127

[51] Int. Cl.[3] ..... B65B 67/12

[52] U.S. Cl. ..... 53/390; 53/384; 141/391; 248/97; 248/99

[58] Field of Search ..... 53/384, 390; 248/97, 248/99; 141/316, 390, 391

[56] References Cited

U.S. PATENT DOCUMENTS

| | | | |
|---|---|---|---|
| 2,731,184 | 1/1956 | Thurber | 53/390 |
| 2,783,010 | 2/1957 | Ferguson | 248/97 X |
| 3,529,766 | 9/1970 | Mott | 248/99 X |
| 3,614,042 | 10/1971 | Jensen | 248/97 |
| 3,905,406 | 9/1975 | Cruse | 53/390 X |
| 4,037,778 | 7/1977 | Boyce | 53/390 X |

FOREIGN PATENT DOCUMENTS

| | | | |
|---|---|---|---|
| 337769 | 5/1959 | Switzerland | 248/99 |

*Primary Examiner*—John Sipos
*Attorney, Agent, or Firm*—Fred Philpitt

[57] ABSTRACT

A bag expander for a flexible bag comprising a frame of two U-shaped rods or wires which are slidably connected so that the frame can be expanded when placed inside the bag mouth. Loops on the ends of each frame member slide on the limbs of the other frame member. U-shaped leg members of rod or wire are pivoted by the ends of the limbs to the bases of the frame members respectively so that the frame can be supported above ground. To slow the expander the frame members are telescoped together and the leg members are folded to lie side by side with the frame members.

7 Claims, 7 Drawing Figures

EXPANDERS FOR THE FILLING OF SACKS AND BAGS

This invention relates to apparatus adapted to support and hold open the mouth of a flexible bag, such as a plastics material bag of the type used for holding household rubbish and garden waste.

Plastic bags are used extensively for holding household rubbish and garden waste, but the filling of such bags is generally difficult if no supporting apparatus is provided, because the bag is not free standing, and the open end will not remain in open condition unless it is supported.

Conventional apparatus for holding such bags open is usually mounted in fixed position, which makes it difficult to move the bag from place to place whilst it is partly full, and furthermore it is not possible to fill the bag from ground level by a scooping action.

An object of the present invention is to provide a simple and low cost apparatus for holding bags and sacks in open condition to facilitate the filling of such bags and sacks. The apparatus is preferably adjustable to fit various sizes of said bags or sacks, and it is preferred that the apparatus should be light in weight yet strong in construction to enable the apparatus effectively to perform its function, and to permit the movement of the bag, when partly full over the ground to enable the filling of the bag at ground level by scooping action.

In a specific construction, the apparatus supports and expands the bag opening from inside the bag, keeping the opening free at the open end of the bag, the apparatus being adapted to stand upon the contents of the bag when partly full, so that the apparatus can be used from the empty condition of the bag to the full condition of the bag.

In the preferred construction of the apparatus it is adapted to be folded to a stowed position, in which it is generally flat and is of minimum dimension for storage. When the apparatus is in the in use position, it should support the open end of the bag, in open expanded condition, without ripping the bag walls.

The apparatus of the invention preferably includes a square rectangular frame made up of two frame members which are slidably attached to alter the size of said frame. Preferably, the apparatus is provided with two leg means for supporting the frame at the corners thereof, each such leg means comprising a U-shaped leg member of which the two limbs are hinged to the corners of the frame, and such that the leg members are able to lock in a position of use adapted to support the frame, or the leg member can be swung into a stowed position in which the leg member is folded into nesting position with the frame members.

It is further preferred that the frame members are relatively adjustable in position one related to the other, and that said locking means of the frame members will be operative in a number of different relatively adjusted positions to suit bags of different sizes.

In the use of the apparatus, the frame and leg members, when in the unfolded in use position, will be located inside the bag, with the frame members being adjusted to expand the wall of the bag and hold same in open condition. By this arrangement, the legs can be arranged to keep the frame at a certain level above the bottom of the bag or the top of the contents of a partly filled bag. As the bag is filled, the legs will be arranged to be supported on the contents of the bag, and will raise the opening of the bag as the frame is raised accordingly. The frame members preferably are provided with means to retain the wall of the bag thereto.

The locking means also preferably serve to form the joint means between the frame members, said locking means comprising loops attached to the limb ends of the said frame members, said loops being positioned at preferred angles in relation to the sides of said frame members so as to provide infinite adjustment locations to enable the frame size to be adjusted relative to the bag to be held open thereby.

The leg members may be adapted to be engaged with the frame members by means of loops and tabs.

The means for retaining the bag end to the frame members may comprise bag fastening means such as clamps.

An embodiment of the apparatus according to the invention will now be described by way of example with reference to the accompanying drawings, wherein.

Figure 1:
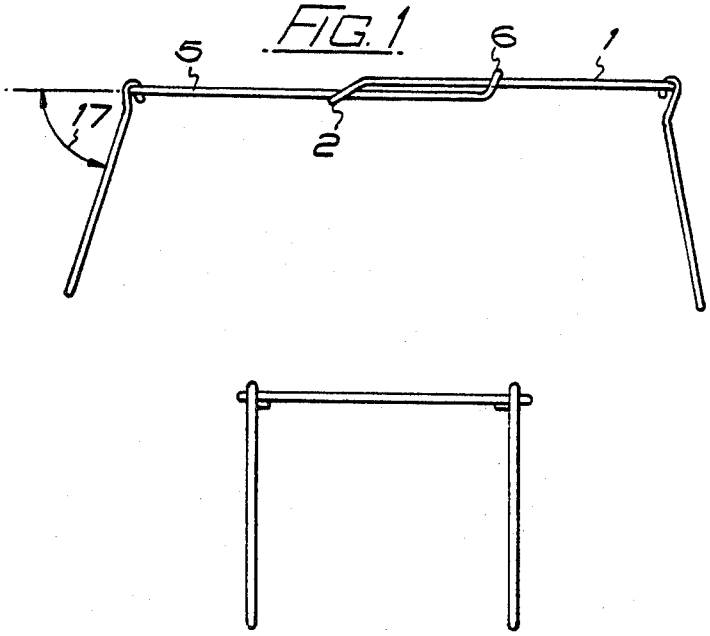
FIG. 1 shows a frontal view and a side view of the apparatus in the extended position.
Figure 2:
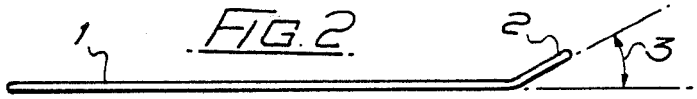
FIG. 2 shows a top view and a side view of one frame member of the frame.
Figure 2:
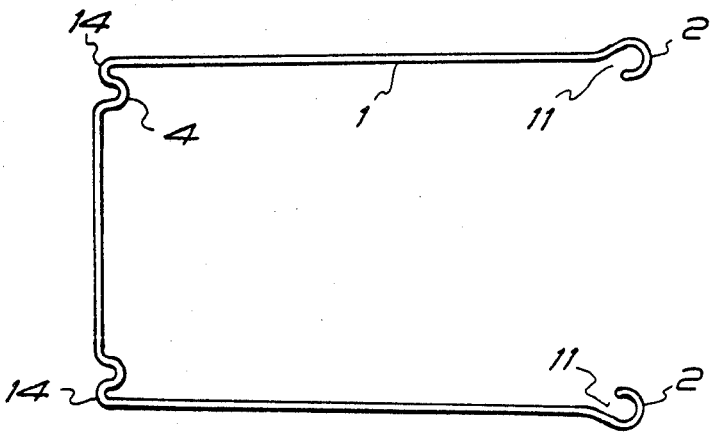
Figure 3:
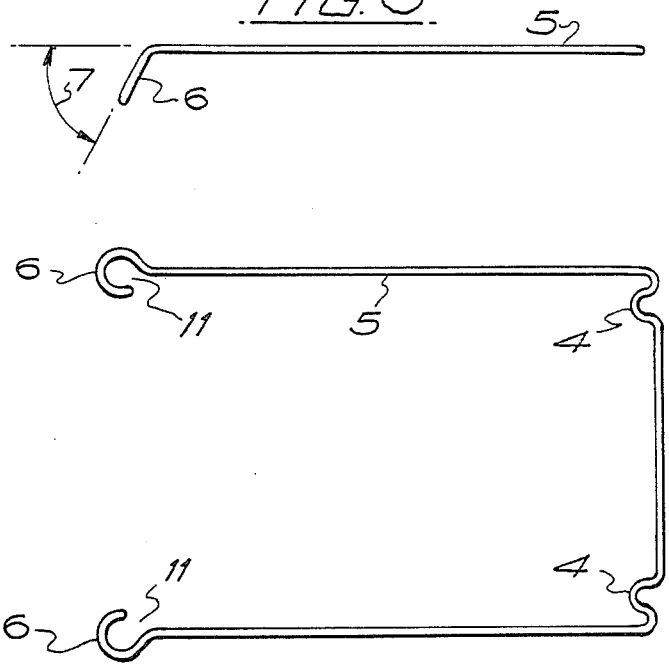
FIG. 3 shows a top view and a side view of the other frame member of the frame.
Figure 4:
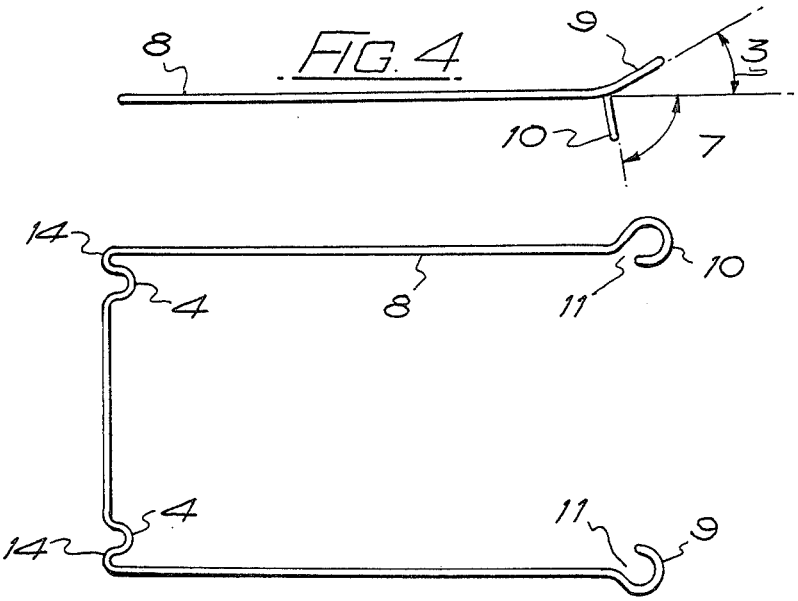
FIG. 4 shows a top view and a side view of a preferred alternative frame member of the frame.

Referring to the drawings, a U-shaped member frame 1, (shown on its own in FIG. 2), contains locking loops 2 which are formed in said frame member and set at a preferred angle 3 of from 135 to 5 degrees in relation to the sides of said frame member. The said frame member 1 is provided with base loops 4. The other U-shaped member frame 5, (as shown on its own in FIG. 3), contains guide loops 6 which are formed in said frame members and set at a preferred angle 7 of from 135 to 45 degrees in relation to the sides of said frame member. Said frame member 5 is provided with base loops 4 which are formed in said frame member. As a preferred alternative, a U-shaped member frame 8, as shown in FIG. 4, contains locking loop 9 which is formed in one arm of said frame member and set at a preferred angle 3 of from 135 to 5 degrees and guide loop 10 which is formed in the other arm of said frame member and inclined oppositely at preferred angle 7 of from 135 to 45 degrees in relation to the sides of said frame member. Said alternative frame member 8 is provided with base loops 4 which are formed in said frame member.

Figure 5:
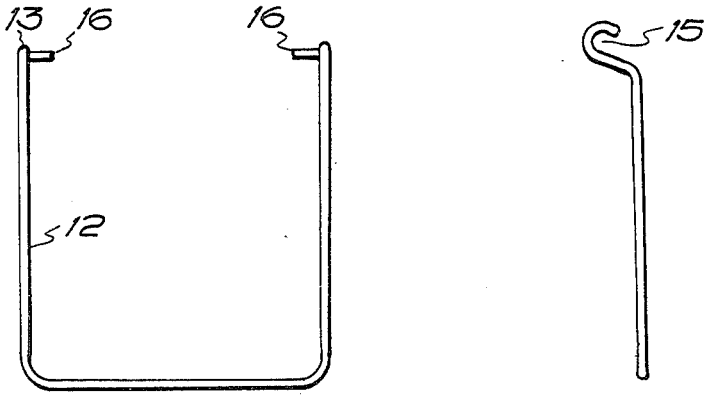
FIG. 5 shows a frontal view and a side view of one of the leg members.

The U-shaped leg member 12, FIG. 5, contains loops 13 and stop tab 16 that fit under loops 4 and limit the pivoting of the legs.

In assembly of the apparatus, the frame members 1 and 5 are interlocked by loops 2 and 6 which are provided with gaps 11 to facilitate insertion of said frame member sides into said loops 2 and 6. Said loops are then pinched to close said gaps 11 to secure the sides of said frame members in said loops and to be slidably adjustable in relation to each other. In the preferred alternative, two frame members 8 are inversely interlocked by loops 9 and 10 which are provided with gaps 11 to facilitate insertion of said frame member sides into said loops 9 and 10. Said loops are then pinched to close said gaps 11 to secure the sides of said frame members in said loops and to be slidably adjustable in relation to each other. It is deomonstrated that the preferred alternative configuration of said frame members 8 only requires two identical frame members to form said frame of the invention whereas in the first alternative two different frame members 1 and 5 are used. The legs 13 are assembled to said frame members 1 and 5 or alternative frame members 8 by attaching loops 13 to bends 14 in said frame members, said loops to be pinched to close gap 15 to secure said legs to said frame members. When in the extended and locked position with stop tabs 16 set against base loops 4, said legs 12 spread out at an angle 17 of from 90 to 45 degrees in relation to the sides fo said frame members 1 and 5 or alternative frame member 8.

Figure 6:
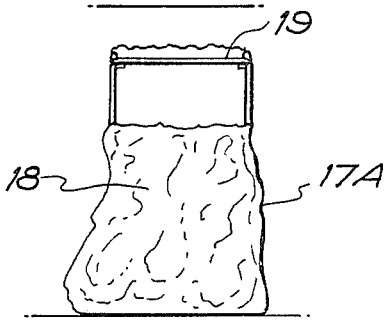
FIG. 6 shows the positioning of the apparatus within the bag in the upright filling position.

In the use of the apparatus, and from the folded position, the legs 12 are swung out to the extended and locked position and the frame is adjusted to be introduced into the bag opening. The bag sides are then folded over the frame which is expanded to extend the bag opening and position the frame as shown in FIG. 6, inside bag 17A. The frame is locked in the expanded position by loops 2 or 9 which set against the sides of said frame members through angle 3 which action is aided by the pressure of the bag sides against legs 12 that upwardly press against the frame members through stop members 16 so as to wedge said loops against the sides of said frame members.

Figure 7:
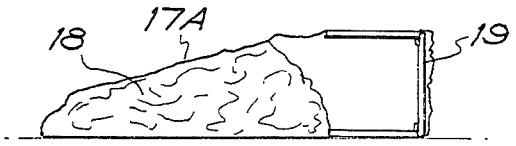
FIG. 7 shows the positioning of the apparatus within the bag for ground scoop filling.

If said bag is empty, legs 12 rest on the ground inside the bag, but as the bag progressively is filled, the contents which pass through the frame down to the bottom of the bag, serve to support the apparatus, which then is repositioned on top of the contents 18 as shown in FIG. 6. As the bag is filled, the apparatus 19 climbs inside the bag on top of the content without being otherwise anchored to the ground for support which feature facilitates the movement of the bag from spot to spot. The apparatus 19 may also be positioned sideways o the ground to scoop fill bag 17A as shown in FIG. 7.

When the bag is full, the frame is unlocked by bending the two frame members downward which action disengages the sides of the frame member in loops 2 or 9 and causes the frame members to slide together. The frame is then removed from the bag. The apparatus may then be folded by swinging legs 12 back over the frame members 1 and 5 or 8 disengaging tabs 16 from base loops 4.

It is believed that the advantages of the above described embodiment will be apparent as it provides effective means for filling of bags in a most practical and convenient way.

The described invention is of robust and durable design. All the parts may be manufactured of suitable material such as wire and the assembly of the apparatus may be made by inserting member parts through loops without the need for other fastening devices which will insure a low cost to manufacture.

It will be appreciated that, while essentially portraying the subject bag expander, the enclosed drawings should not limit the scope of the invention in general.

I claim:

1. In a wire or rod device for maintaining the open end of a flexible bag in an open position so that the interior of the bag can be filled, said device comprising in combination (a) a generally rectangular-shaped frame of variable area composed of a first U-shaped frame member having two side legs and a bottom end, and a second U-shaped member having two side legs and a bottom end, the side legs of said first and second frame members having means for freely slidably engaging each other so that they are slidable toward and away from each other in closely parallel planes, with the open ends of said U-shaped frame members facing each other, and (b) a U-shaped side member pivotably attached to the bottom end of each of said U-shaped frame members, each U-shaped side member having two side legs and a bottom end which are to be inserted in said bag, the improvement which comprises said means for freely slidably engaging said legs set forth in (a) including locking means for locking said legs together upon oppositely pivoting of said legs set forth in (b), and restricted pivotal attachment means for attaching each side member to a frame member so that each side member can be pivoted from a first folded position which is essentially above and parallel to said frame members through a limited arc to a second position beneath said frame members, said limited arc being within the range of 225°–270°, so that when said side members have been pivoted through said limited arc and are inserted in a bag, the bag presses against said pivoted side members to assist in locking said legs of said frame members to each other through said locking means.

2. A device according to claim 1 wherein said pivotal attachment means comprises (1) a pair of spaced apart loops on the bottom end of each frame member, and (2) a loop and stop tab combination adjacent the outer end of each of the side legs of said side member, said loop and stop tab combinations engaging said loops on the bottom end of each frame member.

3. A device according to claim 2 wherein said stop tabs extend at an angle which is substantially perpindicular to the side legs of said side member.

4. A device according to any one of claims 1–3 wherein said means for freely slidably engaging said legs comprising means of loops located at the ends of the side legs, the loop at the end of each side leg surrounding one side leg of the other frame member, said loops being disposed in planes that are at an angle to the planes of the essentially parallel frame members.

5. A device according to claim 4 wherein the loops on each pair of side legs that are slidable with each other are angled in different directions.

6. A device according to claim 2 wherein said loops (1) lock against said side legs of said side members through pressure exerted on said side members when said frame members and side members are in an extended position and inserted in said bag to extend its open end.

7. A device according to claim 4 or 5 wherein said loops lock against said side legs of said frame members through pressure exerted on said side members when said frame members and said members are in an extended position and inserted in said bag to extend its open end.

* * * * *